US006555801B1

(12) United States Patent
LeMieux et al.

(10) Patent No.: US 6,555,801 B1
(45) Date of Patent: Apr. 29, 2003

(54) INDUCTION HEATING COIL, DEVICE AND METHOD OF USE

(75) Inventors: Aaron P. LeMieux, Gates Mills, OH (US); Harris E. Hanser, Bristolville, OH (US); Robert E. Hosterman, Warren, OH (US)

(73) Assignee: Melrose, Inc., Cleveland, OH (US)

( * ) Notice: Subject to any disclaimer, the term of this patent is extended or adjusted under 35 U.S.C. 154(b) by 0 days.

(21) Appl. No.: 10/055,449

(22) Filed: Jan. 23, 2002

(51) Int. Cl.[7] ..... H05B 6/44

(52) U.S. Cl. ..... 219/656; 219/671; 219/674; 219/675

(58) Field of Search ..... 219/655, 656, 219/671, 672, 674, 675, 635; 266/129

(56) References Cited

U.S. PATENT DOCUMENTS

| | | | | |
|---|---|---|---|---|
| 2,182,820 A | | 12/1939 | Pisarev | |
| 2,360,835 A | | 10/1944 | Kongsted et al. | |
| 2,383,992 A | | 9/1945 | Sherman | |
| 2,423,054 A | | 6/1947 | Strickland, Jr. | |
| 2,450,623 A | | 10/1948 | Anderson | |
| 2,513,376 A | | 7/1950 | Strickland, Jr. | |
| 2,604,419 A | | 7/1952 | Herbenar | |
| 2,620,433 A | | 12/1952 | Denneen et al. | |
| 2,788,426 A | * | 4/1957 | Thompson | 219/660 |
| 2,933,584 A | | 4/1960 | Thielsch | |
| 3,120,596 A | | 2/1964 | Sommer | |
| 3,320,398 A | | 5/1967 | Armstrong | |
| 3,424,886 A | | 1/1969 | Ross | |
| 3,431,382 A | | 3/1969 | Esche et al. | |
| 3,996,442 A | | 12/1976 | Moreland, II et al. | |
| 4,017,704 A | | 4/1977 | Collins, III et al. | |
| 4,048,458 A | | 9/1977 | Zirk, Sr. | |
| 4,090,698 A | | 5/1978 | Mucha et al. | |
| 4,115,677 A | | 9/1978 | Yamamura et al. | |
| 4,122,321 A | | 10/1978 | Cachat | |
| 4,271,345 A | | 6/1981 | Palmer et al. | |
| 4,296,295 A | | 10/1981 | Kiuchi | |
| 4,307,278 A | | 12/1981 | Lewis | |
| 4,317,978 A | | 3/1982 | Nebesar | |
| 4,420,667 A | | 12/1983 | Lewis | |
| 4,429,206 A | | 1/1984 | Kothmann | |
| 4,447,691 A | | 5/1984 | Mizukawa et al. | |
| 4,453,067 A | | 6/1984 | Karklys et al. | |
| 4,468,549 A | | 8/1984 | Arnosky | |
| 4,475,721 A | | 10/1984 | Pamart | |
| 4,482,793 A | | 11/1984 | Lewis | |
| 4,506,132 A | | 3/1985 | Keller | |
| 4,538,279 A | | 8/1985 | Keller | |
| 4,675,488 A | | 6/1987 | Mucha et al. | |
| 4,744,836 A | | 5/1988 | Pfaffmann | |
| 4,749,837 A | | 6/1988 | Mucha et al. | |
| 4,757,170 A | | 7/1988 | Mucha et al. | |
| 4,761,530 A | | 8/1988 | Scherer et al. | |
| 4,785,147 A | | 11/1988 | Mucha et al. | |
| 4,786,722 A | | 11/1988 | Umemoto et al. | |

(List continued on next page.)

OTHER PUBLICATIONS

Inoh et al., U.S. patent application Publication No. US 2001/0001465 A1; Publication Date: May 24, 2001; U.S. Ser. No. 09/402,964.

*Primary Examiner*—Philip H. Leung
(74) *Attorney, Agent, or Firm*—Renner, Kenner, Greive, Bobak, Taylor & Weber

(57) ABSTRACT

The invention provides an improved induction heating coil, an induction heating device including the induction heating coil and a method for heating a workpiece with the induction heating device. The induction heating coil for heating a workpiece includes an elongated solenoid-type induction heating coil and at least one pancake-type coil positioned within a portion of the elongated solenoid-type induction heating coil, where the solenoid-type coil and the pancake-type coil are in electrical connection with each other.

27 Claims, 6 Drawing Sheets

U.S. PATENT DOCUMENTS 4,788,394 A 11/1988 Vanneste et al.
4,797,525 A * 1/1989 Keller ..... 219/638
4,874,916 A 10/1989 Burke
5,034,586 A 7/1991 Havas et al.
5,052,597 A 10/1991 Bruckner
5,054,664 A 10/1991 Bruckner
5,113,049 A 5/1992 Border et al.
5,304,767 A 4/1994 McGaffigan et al.
5,376,774 A 12/1994 McGaffigan et al.
5,428,208 A * 6/1995 Chatterjee et al. ..... 219/635
5,444,220 A 8/1995 Hansen et al.
5,630,958 A 5/1997 Stewart, Jr. et al.
5,691,685 A 11/1997 Delucia
5,844,213 A 12/1998 Peysakhovich et al.
6,008,480 A 12/1999 Lund
6,188,054 B1 2/2001 Ohta
6,255,634 B1 7/2001 Bowers
6,300,608 B2 10/2001 Inoh et al.
6,320,168 B1 11/2001 Kimata et al.

* cited by examiner

INDUCTION HEATING COIL, DEVICE AND METHOD OF USE

TECHNICAL FIELD OF THE INVENTION

The present invention generally relates to the field of induction heating. The present invention more particularly relates to an induction heating coil and method of using the induction heating coil to rapidly and uniformly heat a workpiece.

BACKGROUND OF THE INVENTION

An induction heating apparatus generally includes an alternating current power supply that is connected to an induction coil. The induction coil can be a single turn coil, but typically includes a plurality of individual turns of electrically conductive wire or tubing. An induction coil including a plurality of individual turns is commonly known as a multi-turn coil.

Induction heating is performed by disposing a workpiece to be heated within the induction coil and passing an alternating electric current through the induction coil. As the alternating electric current is passed through the induction coil, the coil generates an electromagnetic field. The eddy currents induced in the workpiece by the electromagnetic field causes the workpiece to become heated.

Induction heating is commonly used to heat industrial gas cylinders. The optimum configuration for an induction heating coil powered from a single power supply would include a coil that has a configuration that generally matches the geometrical shape of the cylinder to be heated, while maintaining a satisfactory air gap between the inner surface of the coil and the outer surface of the workpiece. The use of such a coil to heat an industrial cylinder, however, results in the sides walls of the cylinder being heated much more rapidly than the domed end of the cylinder. This non-uniform heating of the cylindrical workpiece can be contributed to the fact the electromagnetic field flux of such a coil weakens as the side walls of the workpiece approaches the end of the coil.

If the power supply to the induction coil is terminated when the side walls of a cylindrical workpiece initially reaches a desired predetermined temperature, then the domed end of the workpiece will not reach the desired temperature. Additionally, if the induction coil continues to be energized by the power supply until the domed end of the cylindrical workpiece reaches the desired temperature, then the side walls of the workpiece will exceed the desired temperature and, therefore, will be too hot. Under both circumstances, the process will result in a workpiece that is not uniformly heated.

In addition, an ever present problem with the use of a multi-turn cylindrical induction coil is that the electromagnetic field produced by the induction coil varies along the length of the coil. Heating of a workpiece with a multi-turn cylindrical induction coil, therefore, often results in the non-uniform heating of a workpiece.

Many attempts have be made in the art to overcome the problems of nonuniform induction heating of workpieces. U.S. Pat. No. 2,422,417, for example, discloses an induction heating apparatus with a rotatable work conveyer to provide uniform heating of a workpiece.

U.S. Pat. No. 2,823,289 discloses an induction heating apparatus including a single induction heating coil and a sleeve or object-guiding insert that is placed into the induction heating coil.

U.S. Pat. No. 3,120,596 discloses an induction heating coil for even heating of elongated workpieces of differing lengths. The induction heating coil includes a first coil section that has a length that is adequate for even heating of the shortest workpieces, together with a group of axially spaced coil sections at the end of the first coil section.

U.S. Pat. No. 3,612,804 discloses an induction heating coil including an elongated coil having an elongated internal passageway through which members pass and an improved guide means extending between the entrance and exit of the passageway for guiding members through the coil. The improved guide means includes a contoured portion between the entrance and exit of the coil such that the members do not pass through the coil with their abutting ends in full contact with each other.

U.S. Pat. No. 3,725,630 discloses an inductive coil for heating a loop of conductive material. The inductive coil includes first and second concentric closed inductive loops of different sizes to receive a loop of conductive material between them. The inductive loop provides a structure wherein current will flow through the loops in series and in opposite directions to provide uniform heating of a closed loop of conductive material.

U.S. Pat. No. 4,538,279 discloses an induction coil in the form of a pancake coil for crucible-free zone melting of semiconductor crystal rods. The coil includes a primary winding surrounding a semiconductor rod to be remelted in the form of a ring through which cooling liquid flows, a secondary winding surrounding the primary winding and having a side facing the semiconductor rod and an energy concentrator lying in the plane of the primary winding.

U.S. Pat. No. 4,468,549 discloses an induction heater arrangement for forging bar stock. The heater arrangement includes an induction heating coil with a longitudinally extending axial passageway for receiving bar length to be heated. A reciprocal flux diverter is moved into the open end of the heating coil passageway to surround the residually heated terminal end of the bar length to divert the flux and prevent it from penetrating and heating the residually heated terminal end of the inserted bar.

Prior attempts at simultaneously heating the side walls and domed ends of an elongated industrial cylindrical workpiece to a predetermined uniform temperature have included the use of two independent power supplies—one power supply for the side wall coil and one power supply for the domed end coil. The use of two independent power supplies was employed in an attempt to allow the characteristics of the dissimilar zones of the side walls and domed end to be matched.

Another attempt at simultaneously heating the side walls and domed ends of an elongated cylindrical workpiece to a predetermined uniform temperature included the use of a complex electronic power sharing arrangement that energizes each individual induction coil.

The efficiency of an induction heating device ultimately depends on the amount of electromagnetic energy generated by an induction coil that can be converted into heat energy in the workpiece. The prior art methods utilize more complex, more costly, but less efficient equipment for induction heating of workpieces. As such, there still remains a great need in the art for a simple and cost effective configuration for an induction heating coil and device for rapidly and uniformly heating workpieces. In particular, there is a great need for a simple and cost effective induction heating coil and device for rapidly, simultaneously and uniformly heating all portions of an elongated industrial cylinder workpiece, including the side walls and domed end portions of an industrial cylinder.

SUMMARY OF THE INVENTION

The present invention, in one embodiment, includes an induction heating coil comprising an elongated solenoid-type induction heating coil having opposite open ends and at least one pancake-type coil entirely positioned within a portion of said elongated solenoid-type induction heating coil, wherein said solenoid-type induction heating coil is in electrical connection with said pancake-type induction coil.

The present invention, in another embodiment, includes an induction heating device for heating a workpiece comprising: an induction heating coil comprising an elongated solenoid-type induction heating coil having opposite open ends and at least one pancake-type coil positioned entirely within a portion of said elongated solenoid-type induction heating coil, wherein said solenoid-type induction heating coil is in electrical connection with said pancake-type induction coil; and a high frequency power source in electrical connection with said solenoid-type coil and said pancake-type coil for supplying high frequency electric power to said coils.

The present invention, in another embodiment, includes a method of heating a workpiece comprising: providing an induction heating coil comprising an elongated solenoid-type induction heating coil having opposite open ends and at least one pancake-type coil positioned within a portion of said elongated solenoid-type induction heating coil, wherein said solenoid-type induction heating coil is in electrical connection with said pancake-type induction coil; positioning said workpiece to be heated in proximity to said pancake-type induction coil; and supplying said coils with a source of high frequency power to induce a current in the workpiece for a time sufficient to heat said workpiece to a desired temperature.

DETAILED DESCRIPTION OF THE PREFERRED EMBODIMENT

Figure 1:
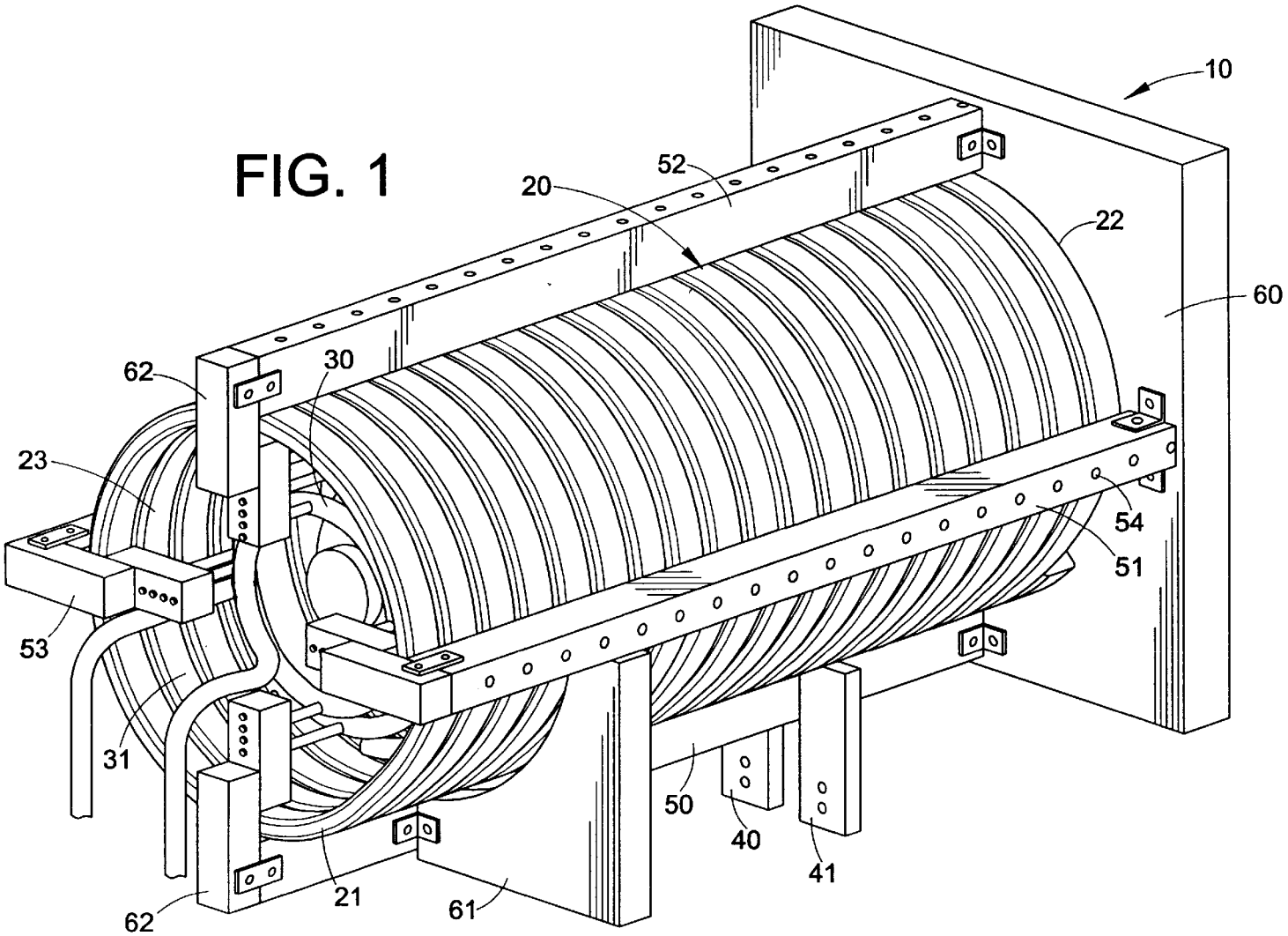
FIG. 1 is a perspective view of an illustrative embodiment of the induction heating coil of the present invention.

The present invention provides a unique configuration for an induction heating coil and a device incorporating the induction heating coil. The induction heating coil and device are designed to simultaneously and rapidly heat the side walls and end portions of a workpiece, such as an hollow industrial gas cylinder, while avoiding the temperature transition zone between the side walls and end portions of the workpiece.

The induction heating coil and device of the present invention can be better understood from the following detailed description of the preferred embodiments of the invention and description of the accompanying drawings.

In general, the induction heating coil of the present invention includes at least one pancake-type induction heating coil that is positioned within the length of a solenoid-type induction heating coil and that is in electrical connection with the solenoid-type induction coil.

The term "solenoid-type" induction heating coil refers to an elongated, generally cylindrical, electrically conductive induction heating coil that is formed from a plurality of individual coil turns. The solenoid-type induction heating coil includes a plurality of helically or spirally wound individual coil turns. The spirally wound coil turns may be longitudinally spaced apart with respect to each other for the purpose of insulating the coil turns from each other. Depending on the desired application or on the length of the workpiece to be heated, the solenoid-type induction heating coil can be of any length.

The term "pancake-type" induction heating coil refers to an electrically conductive induction heating coil that is formed of at least one spirally or helically wound coil turn. Preferably, the pancake-type coil comprises a plurality of spaced 30 apart, individual coil turns that are wound in a spiral-like manner to form a generally bowl- or conical-shape, where each successive coil turn has a small diameter than the immediately previous coil turn. The pancake-type induction coil is flexible and can be easily contoured to heat irregularly shaped workpieces.

The term "heating" refers to the process of raising the temperature of a material without causing the material to change its state. The term "heating," however, can also encompass those induction heating processes that raise the temperature of a material such that the material changes its state.

According to the present invention, at least one contoured pancake-type induction heating coil is positioned or disposed inside a portion of the length of a solenoid-type induction heating coil. Preferably, the at least one pancake-type induction heating coil is positioned inside the solenoid-type coil near the end of the length of the solenoid-type coil. The pancake-type induction heating coil is located inside the end of the solenoid coil at a distance that corresponds to what is known in the art as the end overlap dimension. The end overlap dimension is that portion of the solenoid-type induction coil length that typically extends beyond the end of the workpiece to assure that the workpiece is heated to a uniform temperature along its entire length. The use of the end overlap zone assures that all of the workpiece length that needs to be heated to a uniform final temperature is positioned within the full strength electromagnetic field created by the application of the electrical current to the induction heating coil. The end overlap zone avoids the weakening magnetic field that occurs at the extreme ends of an induction heating coil due to the lines of force bending away from the workpiece as they approach the end of the coil to start on their external path around the outside of the induction heating coil. Positioning the pancake-type induction heating coil inside the end of a solenoid-type heating coil assures that the entire length of the workpiece including, most importantly, the transition zone from the side walls to the domed end portion, is located in the full strength electromagnetic field generated by the solenoid-type induction heating coil.

Referring now to FIG. 1, an induction coil 10 of the present invention is shown. The induction coil includes a solenoid-type coil 20 having a plurality of turns that form a tunnel-like structure. While the solenoid-type coil 20 that is shown in FIG. 1 is one illustrative embodiment of the invention having about eighteen individual coil turns, it should be understood that the solenoid-type coil can include any desired number of individual coil turns to form a solenoid-type coil having a specified length. The solenoid-type coil 20 has opposite open ends 21 and 22. The solenoid-type coil has a hollow portion 23 of a substantially uniform diameter that extends along the entire length of the coil and is adapted to receive workpieces to be heated.

According to the embodiment depicted in FIG. 1, a pancake-type induction coil 30 is positioned within a portion of the solenoid-type induction coil 10 While the pancake-type coil that is shown in FIG. 1 is one illustrative embodiment of the invention having about three individual coil turns, it should be understood that the pancake-type coil can also include any desired number of individual coil turns to form a pancake-type coil of differing sizes. The pancake-type induction coil 30 is positioned completely within the solenoid-type induction coil and is in close proximity to the end of the solenoid-type coil. The pancake-type coil 30 does not extend beyond the end of the solenoid-type induction coil 20.

The induction heating coil is provided with terminals 40, 41 to connect the solenoid-type and pancake-type induction coils to a high frequency power source. Support studs 50–53 are used to support the induction heating coil of the present invention. Support studs are constructed from a non-conductive material, such as wood. While support studs are shown in the embodiment depicted in FIG. 1, it should be understood that other acceptable support structures can be used to support the coil turns of the solenoid-type coil such as, for example, the use of a support board in conjunction with the placement of non-conductive, insulating material between the individual coil turns. At least one of support studs 50–53 includes a plurality of recesses or apertures 54 that are adapted to received a securement means located on each turn of the coil. At least one conductive securement means is fixedly attached to a portion of each individual coil turn of the solenoid-type coil. The securement means can include, for example, screws, bolts, pegs or knobs that are adapted to be inserted into aperture 54 of support studs 50–53. In a preferred embodiment, the securement means are bronze bolts that have been brazed onto a portion of each individual coil turn of the solenoid-type coil. The bronze bolts are easily inserted into apertures 54 of support studs 50–53 to secure the solenoid-type coil.

In addition to support members 50–53, the induction coil may further include high temperature resistant, non-conductive members, such as refractory ceramic boards 60 and shaped parts 61, 62. These refractory boards and parts can be used secure the support members of the 50–53. In particular, refractory shaped parts 61, 62 can be used to secure the pancake-type coil 30 in proper position within the end portion of the solenoid-type coil 20. Angle sections can be used to secure the support studs 50–53 to the refractory supports.

Figure 2:
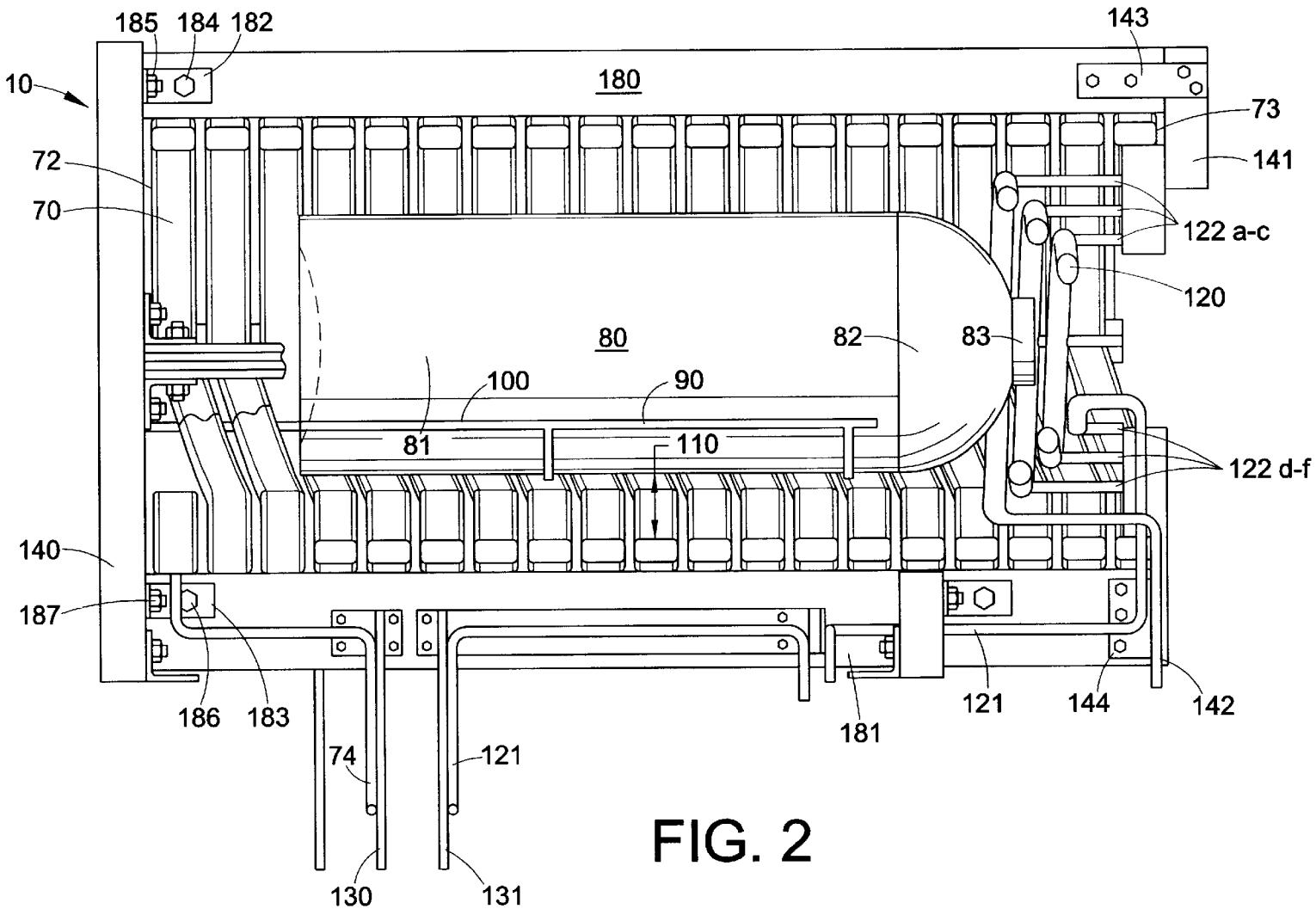
FIG. 2 is a cross sectional view of the induction coil of the present invention having an industrial cylinder inserted in the solenoid-coil.

FIG. 2 shows one illustrative embodiment of the induction coil of the present invention having an workpiece to be heated disposed therein. Induction coil includes a number of individual coil turns that form the solenoid-type coil 70 of a desired length. A section of tubing 74 of solenoid-type coil 70 is connected to terminal 130. The solenoid-type coil 70 has opposite open ends 72, 73. The workpiece 80 shown is an elongated industrial gas cylinder. The industrial gas cylinder includes side wall portions 81, a domed end portion 82 and terminal neck portion 83. Workpiece 80 is supported within the length of the solenoid-type coil by support rails 100, thereby forming an annular air gap 110 or air space between the outer surface of workpiece 80 and inner surface of the solenoid-type coil 70. The supported workpiece 80 is thus prevented from coming into direct contact with the inner surfaces of the solenoid-type coil 70. A pancake-type induction coil 120 is positioned entirely within a portion of the solenoid-type induction coil 70 and does not extend beyond the end 73 of the solenoid-type coil 70. A section 121 of a turn of the pancake-type coil 120 does extend from the end of the solenoid-type coil 70 and connects to terminal 131. It should be understood that this is necessary to electrically connect the pancake-type coil 120 to the solenoid-type coil 70. Refractory board 140 is secured to end 72 of solenoid-type coil 70 and support studs 180, 181 via angle sections 182, 183 and bolts 184–187. Refractory supports 141, 142 are secured to support studs 180, 181 via plates 143, 144 via bolts. Refractory supports 141, 142 are also secured to pancake-type coil 120 via bolts 122(*a–f*).

Figure 4:
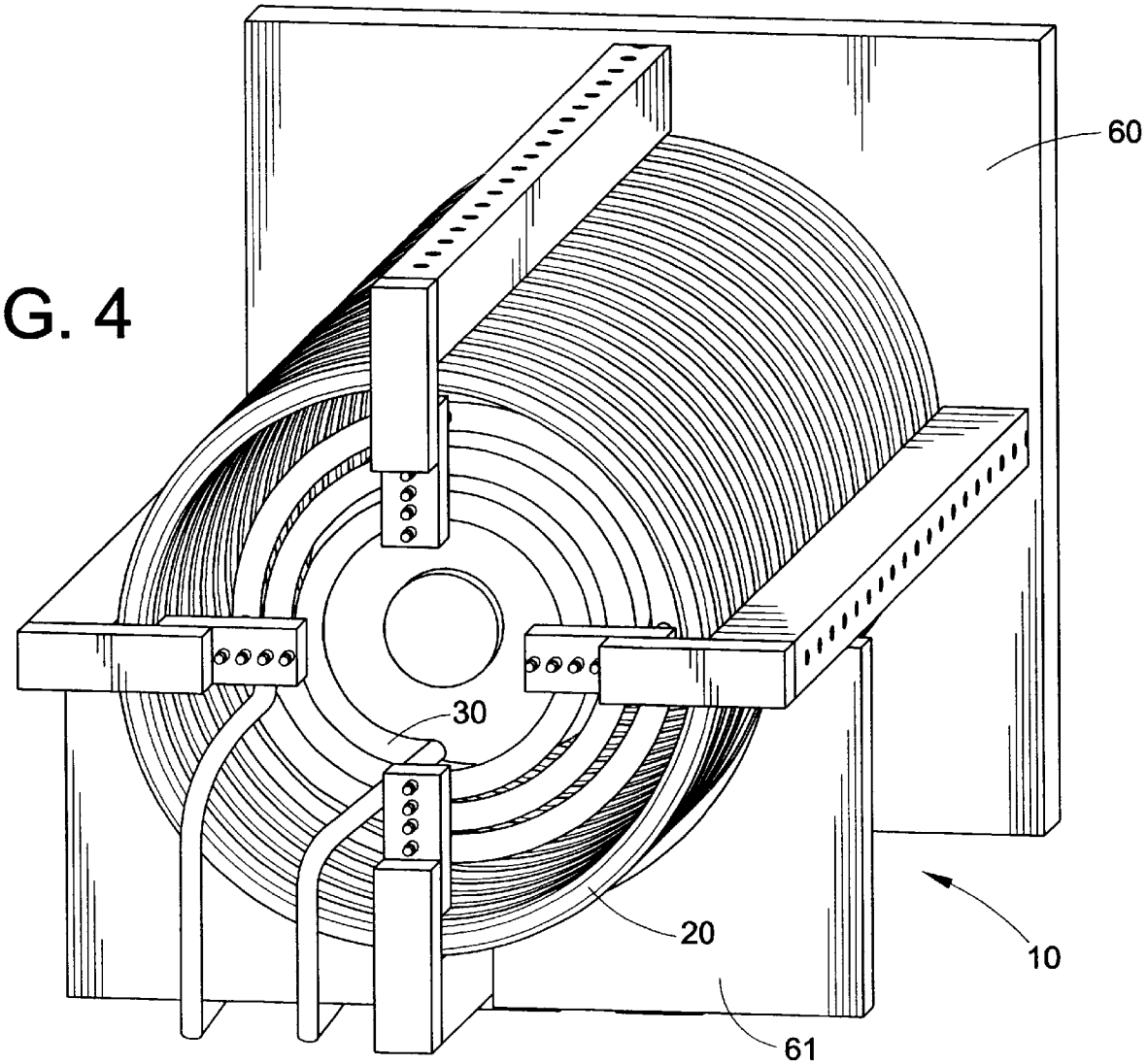
FIG. 4 is a perspective view of an end portion of one embodiment of the induction coil of the present invention.
Figure 5:
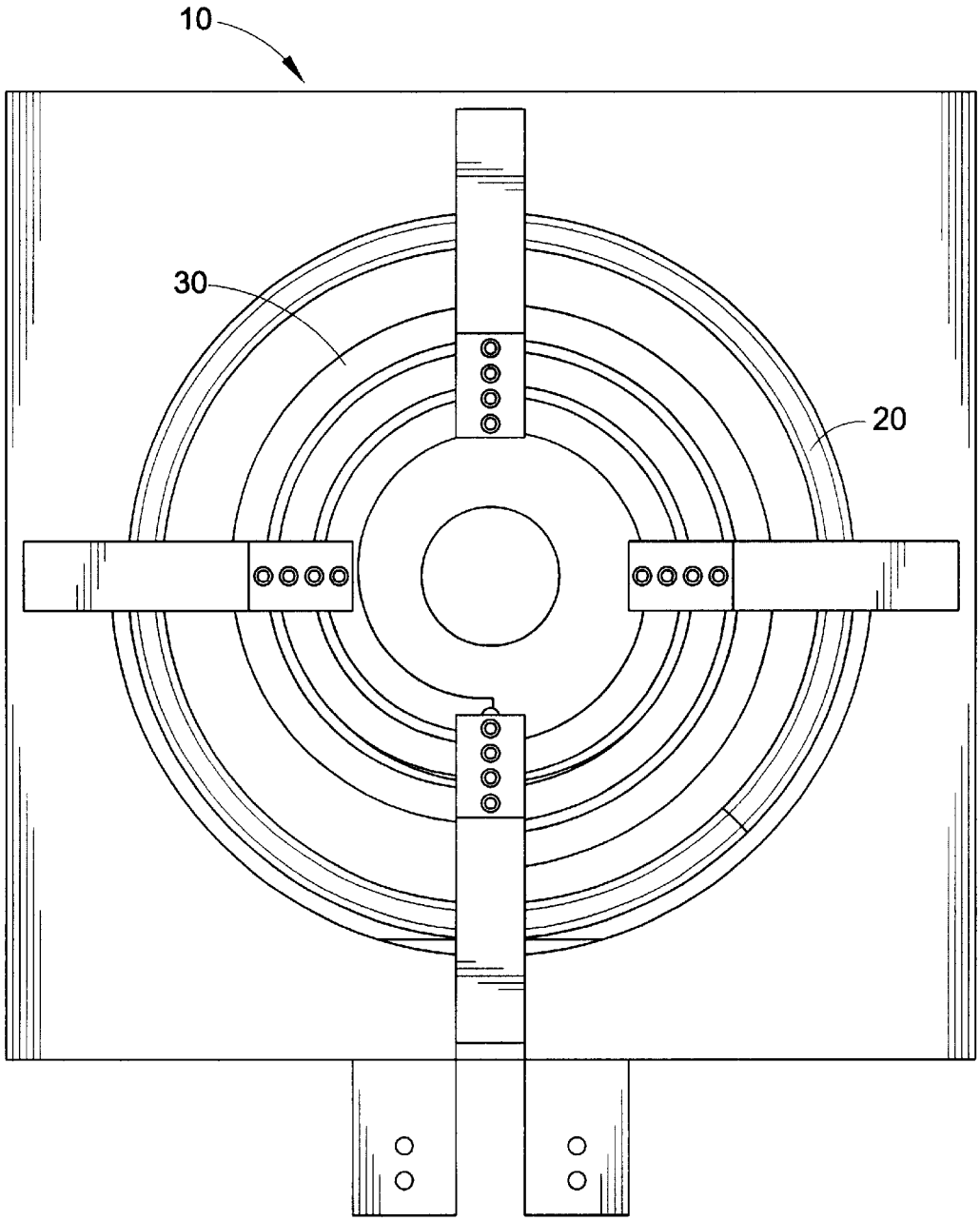
FIG. 5 is an end view of one embodiment of the induction coil of the present invention.
Figure 6:
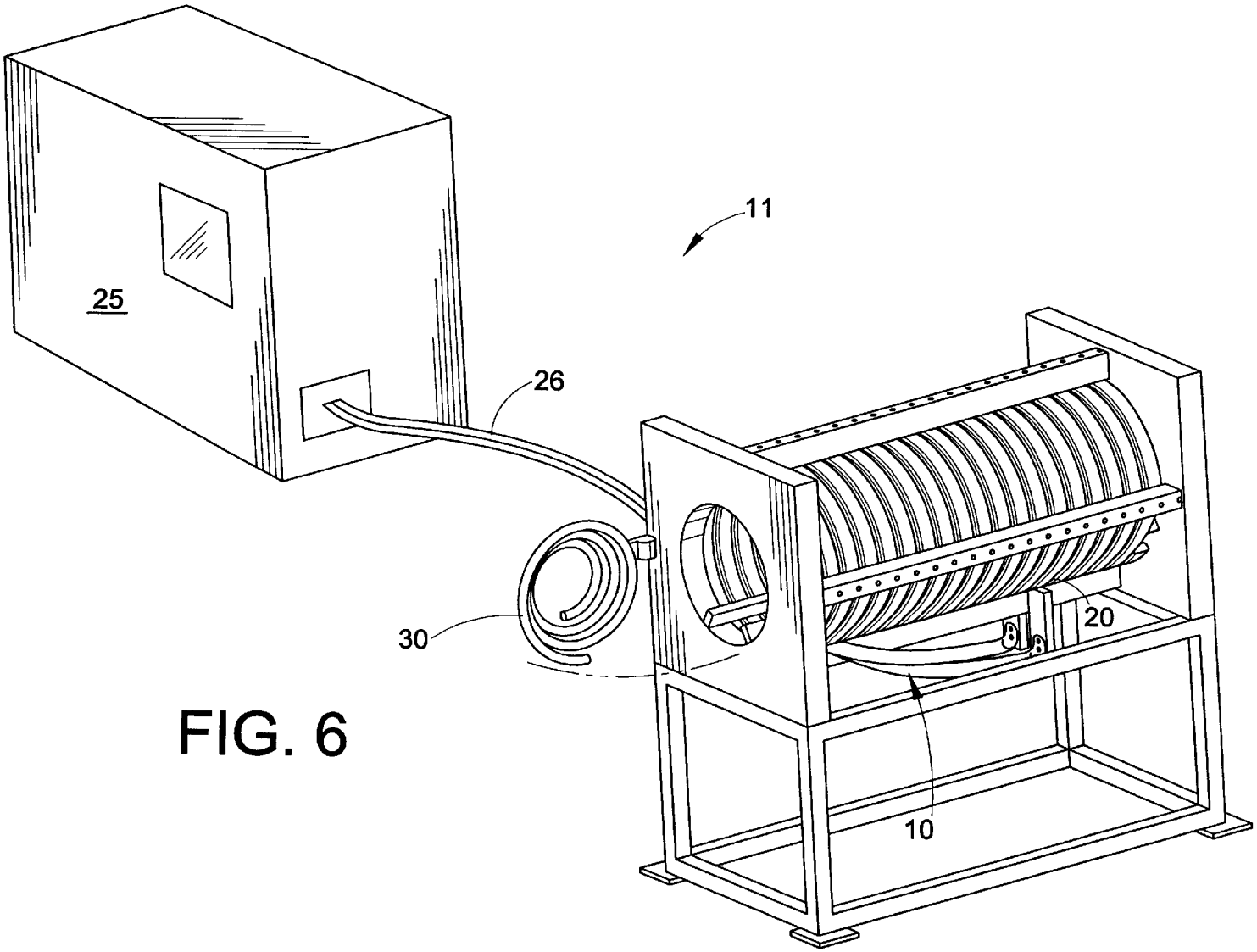
FIG. 6 is an end view of one embodiment of the induction heating device of the present invention.

FIGS. 4 and 5 depicting portions of one embodiment of the induction coil 10 of the present invention showing the solenoid-type 20 and pancake-type coils 30. FIG. 6 shows one embodiment of the induction heating device 11 of the invention. The device includes a solenoid-type coil 20 in electrical connection with pancake-type coil 30. The induction coil is 10 is connection to a high frequency power supply 25 via power leads 26.

Figure 3:
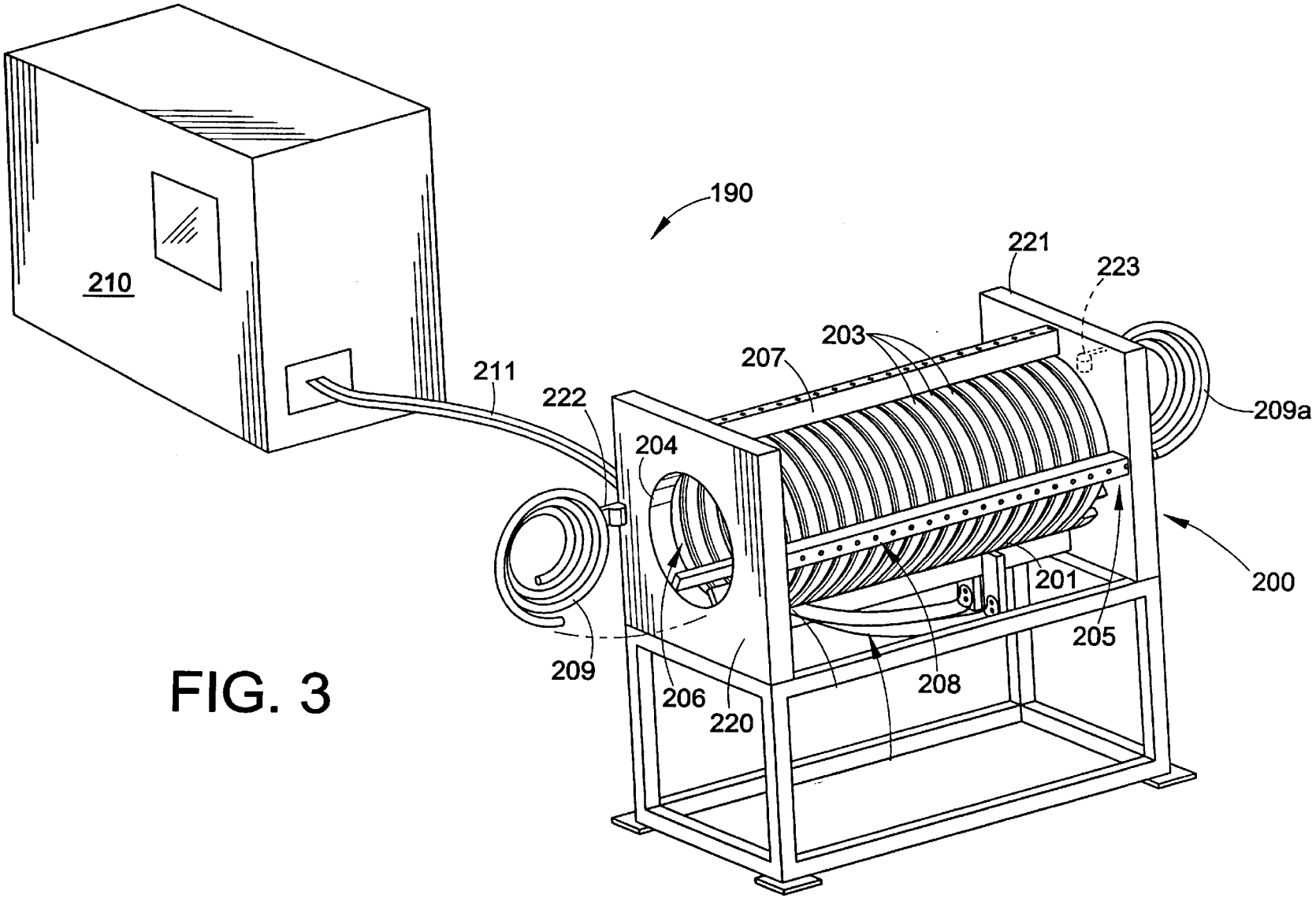
FIG. 3 is a schematic representation of one embodiment of the induction heating device of the present invention shown connected to a high frequency power source.

FIG. 3 is a schematic representation of one embodiment 190 of the induction device of the present invention. The induction heating device 190 includes an induction coil 200 that is connected to a high frequency power source 210. The induction coil 200 includes a solenoid-type coil 201 formed from a number of individual coil turns 203. The solenoid-type coil 201 has opposite open end 204, 205 and a hollow tunnel 206 extending the length of the solenoid-type coil 201. The solenoid-type coil 201 is supported by support studs 207, 208. The induction coil 200 includes two pancake-type 209, 209*a* induction coils that are disposed within proximity opposite ends 204, 205 of the solenoid-type coil 201. According to the embodiment, of FIG. 3, the pancake-type coils 209, 209*a* are attached to refractory board 220, 221 via hinges 222, 223 and are adapted to be opened to allow insertion of a workpiece to be heated. It should be noted that other means, for example, a linear transfer mechanism employing a pneumatic cylinder and cams can be used to position the pancake-type induction coil within the solenoid-type induction coil. After the workpiece is inserted into the solenoid-type coil 201, then the pancake-type coils 209, 209*a* are positioned entirely within the opposite end portions 204, 205 of solenoid-type coil 201 and are brought into close proximity to the workpiece to be heated. The induction coil 200 is electrically connected to the high frequency power source 210 via water cooled power leads 211.

The solenoid-type induction coil and the pancake-type induction coil are made from a highly electrically conductive material such as, but not limited to, electrically conductive wire or tubing. The induction coil preferably includes electrically conductive hollow tubing.

The induction coil comprising the solenoid-type coil and the pancake-type coil comprises tubing that is preferably made from one continuous length of highly electrically conductive tubing material. It should be noted, however, that the coils can be made from individual sections or pieces of highly electrically conductive tubing that has been welded or brazed into one continuous length of tubing. Suitable materials, for example, that comprise the conductive tubing material of the solenoid-type coil and pancake-type induction coil include electrically conductive metals and electrically conductive metal alloys. Without limitation, the highly electrically conductive metals that may be used to form the tubing of the solenoid-type and pancake-type induction coils includes copper, gold, and alumina. Without limitation, the highly electrically conductive metal alloys that may be used to form the tubing of the solenoid-type and pancake-type induction coils include brass and bronze. In a preferred embodiment, the is material that is used to form the tubing of the solenoid-type and pancake-type induction coils is copper metal.

The highly electrically conductive tubing that comprises the solenoid-type and pancake-type induction heating coils can be comprised of the same or different electrically conductive material. In one preferred embodiment, the same highly electrically conductive material comprises both the solenoid-type and the pancake-type induction coils.

In a preferred embodiment, the tubing comprising the both the solenoid-type and pancake-type induction coils is copper. The copper tubing conducts the alternating current which produces an electromagnetic field inside the induction coil to create eddy currents in the workpiece. The tubing has an internal passageway that is adapted to permit a coolant, such as air or liquid, to flow therethrough. Preferably, a liquid coolant, such as water, is run through the copper tubing to remove the heat generated by the induction coil current. It should understood that any desired number of coil turns may be employed to form the induction heating coil. Furthermore, the number of individual coil turns is usually dictated by the size and configuration of the workpiece to be heated by the induction heating coil and can be readily ascertained by one having ordinary skill in the art.

In another embodiment, the present invention includes an induction heating device that includes an elongated solenoid-type induction heating coil having opposite open ends and that includes more than one pancake-type coil positioned within a portion of the elongated solenoid-type induction heating coil and that are in electrical connection with the solenoid-type induction heating coil. In another embodiment, two pancake-type induction heating coils may be positioned at desired locations inside the solenoid-type coil. When two pancake-type inductions coils are positioned within the solenoid-type coil, they are positioned in proximity to the open opposite ends of the solenoid-type coil. Using this configuration, the induction coil can be used to heat two workpieces, such as two industrial gas cylinders. According to this embodiment, either one or both of the pancake-type induction heating coils is adapted to be opened, such that a workpiece may be inserted into the solenoid-type coil.

In one embodiment, the inner surface of the solenoid-type induction heating coil can be coated or lined with a high temperature resistant material to insulate the induction coil from the heat that is radiated from the heated workpiece. The coating or lining is preferably selected from high temperature resistant metals and refractory ceramic material. More preferably, the coating or lining of the inner surface of the induction heating coil comprises a refractory ceramic coating or lining, even more preferably, the inner surfaces of the solenoid-type coil is coated with a refractory ceramic coating. Without limitation, the refractory ceramic coating or lining that is useful to coat or line the inner surfaces of the solenoid-type induction coil is alumino-silicate refractory ceramic material.

In another embodiment, the turns of tubing that comprise the solenoid-type and pancake-type induction heating coil do not contain an insulating layer of high temperature resistant metal or high temperature resistant refractory ceramic material. According to this embodiment, the turns of tubing forming the solenoid-type and/or pancake-type induction coils, for example, the turns of copper tubing, are "bare."

The induction heating coil of the present invention may further include a support means to support the workpiece to be heated within the solenoid-type coil. The support means is typically constructed such that the support means adequately support a workpiece having a predetermined configuration and weight and that can survive the induction heating process.

In one embodiment, the support means includes continuous rail supports to support the workpiece to be heated within the solenoid-type induction heating coil during the heating process. The support means may be provided as a pair of spaced apart rails. The spaced apart rails can extend longitudinally along the entire length of the solenoid-type coil. However, it is within the scope of the present invention to provide the support rails only at the inside ends of the solenoid-type coil, such that the support rails extend along the inner surface of the coil from the inside ends of the coil for a length toward the middle of the coil that substantially matches the maximum length of the workpiece to be heated. The support rails perform the dual functions of providing a means on which to place a workpiece to be heated and easily slide, or otherwise forward, the workpiece into position within the induction heating coil and to support the workpiece once in proper position within the induction heating coil.

In order to withstand the induction heating process, the support means can be made from a non-magnetic material having a cross section too small to be heated by induction heating process. However, in another embodiment, the support means can comprise hollow tubing adapted to allow a cooling liquid to flow therethrough.

The rail supports are disposed on the lower portion of the inner surface of the solenoid-type induction heating coil. According to this embodiment, the rail supports extend longitudinally along the entire length of the solenoid-type coil and are spaced apart at a distance sufficient to support the workpiece to be heated. Alternatively, a portion of the support rails can be embedded in the high temperature resistant coating of the inner surfaces of the solenoid-type coil.

In another embodiment, the invention provides an induction heating device or apparatus for heating a workpiece. The induction heating device comprises an induction coil that includes an elongated solenoid-type induction heating coil having opposite open ends and at least one pancake-type coil positioned within a portion of the elongated solenoid-type induction heating coil. The solenoid-type and pancake-type coils are in electrical connection.

The solenoid-type and pancake-type induction coils have input leads that are adapted to be connected to a source of high frequency power. Both the solenoid-type coil and the pancake-type coil are in electrical connection with a single high frequency power source, which supplies a high frequency electric power to both coils. In a preferred embodiment, the high frequency power supply provides a supply of alternating current power to the induction coils. The application of the high frequency power to the induction coils can be easily controlled by the means of a simple control switch.

The induction heating coil can simultaneously and rapidly heat an article that is positioned within the coil. This induction heating coil is especially useful for rapidly and uniformly heating an industrial cylinder, such as a gas cylinder or chemical reactor vessel. The induction heating coil of the present invention can heat an industrial cylinder without the temperature transition zone between the side walls of the cylinder and thee end of the cylinder that would normally occur with the use of induction heating coils of the prior art.

The induction heating coil of the present invention surprisingly and unexpectedly provides a cost efficient, rapid and accurate to simultaneously and uniformly heat the side walls and domed end of an elongated industrial gas cylinder.

In another embodiment, the present invention includes a rapid and accurate method of uniformly heating a workpiece to a desired and predetermined temperature. The method of heating a workpiece, such as an elongated industrial gas cylinder, includes providing an induction heating device that includes an elongated solenoid-type induction heating coil and at least one pancake-type coil positioned within a portion of said elongated substantially cylindrical induction heating coil. The portion of the workpiece to be heated is brought into close proximity with a portion of the pancake-type induction heating coil by contouring the pancake-type coil about the outer surface of the workpiece to be heated. The term "close proximity" is intended to refer to the positioning of the outer surface of the workpiece in relation to the pancake-type induction coil. Preferably, the distance between the outer surface of the workpiece and the pancake-type coil should be such that the magnetic field generated by the pancake-type coil does not melt the workpiece, but that the portion of the workpiece to be heated is within the magnetic field generated by the coil to maximize the induction heating of that portion of the workpiece. As such, an air gap is formed between the outer surface of the portion of the workpiece to be heated and the pancake-type induction coil. The air gap must be such that the induction coil does not contact the workpiece. Without limitation, the air gap between the workpiece and the pancake-type induction coil preferably is about 0.1 to about 1 inch, more preferably from about 0.16 inches to about 0.5 inches and most preferably from about 0.25 to about 0.5 inches.

The induction heating coil is then provided or energized with a source of high frequency power. The power supplied to the induction heating coil is a supply of alternating current power. The provision of the high frequency alternating current to the induction coil produces an electromagnetic field within the solenoid-type coil. The electromagnetic field produces eddy currents in the workpiece and, thus, the workpiece is heated. The high frequency current is provided to the induction coil for a time sufficient to heat the workpiece to a desired and predetermined temperature.

The method of using the induction coil and device of the present invention is useful for inductively softening an irregularly shaped workpiece, such as an industrial gas cylinder. Without being bound by any particular theory, the softening of the workpiece occurs through annealing, stress relieving or tempering of the workpiece by induction heating. It should be noted, however, that the induction heating coil and device of the present invention is also applicable, for example, inductive hardening, melting, welding and brazing processes. As such, the method of the present invention is not limited to hardening of workpieces by induction heating.

EXPERIMENTAL

The following example is set forth to describe the induction heating coil and device of the present invention in further detail and to illustrate the method of using the induction heating coil and device to uniformly heat all portions of an industrial gas cylinder. It should be noted that the following example is for illustrative purposes only and should not be construed as limiting the present invention in any manner.

EXAMPLE 1

The induction heating dev ice of the present invention was used to soften the outer surface of an electrically conductive, elongated industrial acetylene cylinder by induction heating.

An acetylene gas cylinder selected for induction heating had an outer diameter of about 4 inches and a length of about 13.75 inches. The cylinder was positioned within the inner volume of the solenoid-type induction coil. The cylindrical workpiece was positioned such that its axis is collinear with the axis of the solenoid-type heating coil. After the acetylene cylinder was positioned within close proximity to the pancake-type induction heating coil, the coils were energized with alternating current from a single high frequency power supply.

The induction coils were energized with an alternating current having a magnitude of about 2000 amperes and a frequency of about 3000 Hz (cycles per second). The coils were energized for about 22 seconds.

After the 22 seconds of heating, the source of alternating current to the induction coil was terminated. The heated acetylene cylinder was removed from the induction heating coil. The temperature of the side walls and the dome end of the acetylene cylinder were immediately measured with an infrared temperature monitor. The results of the infrared temperature monitor measurements indicated that the side wall portions and the domed end portion of the acetylene cylinder were uniformly heated to about the same temperature.

The induction heating device and method of using the induction heating coil of the present invention, are not limited to the illustrative embodiments described above, but which include variations, modifications and equivalent embodiments defined by the following claims.

We claim:

1. An induction heating coil for heating a workpiece comprising:

an elongated substantially cylindrical solenoid-type induction heating coil having opposite open ends; and at least one pancake-type coil positioned within a portion of said elongated substantially cylindrical induction heating coil, wherein said solenoid-type coil is in electrical connection with said pancake-type coil.

2. The induction heating coil of claim 1, wherein said at least one pancake-type coil includes one pancake-type induction heating coil disposed within said solenoid-type induction heating coil.

3. The induction heating coil of claim 1, wherein said at least one pancake-type coil includes two pancake-type induction heating coils disposed within said solenoid-type induction heating coil.

4. The induction heating coil of claim 1, wherein said solenoid-type heating coil and said pancake-type heating coil are connected to a single power supply.

5. The induction heating coil of claim 4, wherein said solenoid-type coil and said pancake-type coil are connected in series with the power supply.

6. The induction heating coil of claim 5, wherein power supply supplies a source of alternating current.

7. The induction heating coil of claim 1, wherein an inner surface of said solenoid-type coil comprises a lining or coating of a high temperature resistant material.

8. The induction heating coil of claim 7, wherein said lining or coating is comprised of a refractory ceramic material.

9. The induction heating coil of claim 8, wherein said refractory ceramic material is a refractory ceramic coating of alumina-silicate material.

10. The induction heating coil of claim 1, wherein said solenoid-type coil comprises an insulated support means for supporting said workpiece to be heated within said solenoid-type coil.

11. The induction heating coil of claim 10, wherein said support means comprises a pair of insulated spaced rails.

12. The induction heating coil of claim 11, wherein said pair of spaced rails extend longitudinally along the entire length of said solenoid-type induction heating coil.

13. An induction heating device for heating a workpiece comprising:

an induction coil comprising an elongated substantially cylindrical solenoid-type induction heating coil having opposite open ends; and at least one pancake-type coil positioned within a portion of said elongated substantially cylindrical induction heating coil, wherein said solenoid-type coil is in electrical connection with said pancake-type coil; and a high frequency power source in electrical communication with said solenoid-type coil and said pancake-type coil for supplying high frequency electric power to said coils.

14. The induction heating device of claim 13, wherein said at least one pancake-type coil includes one pancake-type induction heating coil disposed within said solenoid-type induction heating coil.

15. The induction heating device of claim 13, wherein said at least one pancake-type coil includes two pancake-type induction heating coils disposed within said solenoid-type induction heating coil.

16. The induction heating device of claim 13, wherein said solenoid-type heating coil and said pancake-type heating coil are connected to a single power supply.

17. The induction heating device of claim 16, wherein said solenoid-type coil and said pancake-type coil are connected in series with the power supply.

18. The induction heating device of claim 16, wherein power supply supplies a source of alternating current.

19. The induction heating device of claim 13, wherein an inner surface of said solenoid-type coil comprises a lining or coating of a high temperature resistant material.

20. The induction heating coil of claim 19, wherein said lining or coating is comprised of a refractory ceramic material.

21. The induction heating coil of claim 20, wherein said refractory ceramic material is alumina-silicate material.

22. The induction heating coil of claim 13, wherein said solenoid-type coil comprises an insulated support means for supporting said workpiece to be heated within said solenoid-type coil.

23. The induction heating coil of claim 22, wherein said insulated support means comprises a pair of insulated spaced rails.

24. The induction heating coil of claim 23, wherein said pair of insulated spaced rails extend longitudinally along the entire length of said solenoid-type induction heating coil.

25. A method of induction heating a workpiece comprising:

providing an induction heating coil comprising an elongated substantially cylindrical solenoid-type induction heating coil having opposite open ends and at least one pancake-type coil positioned within a portion of said solenoid-type induction heating coil, wherein said solenoid-type is in electrical connection with said pancake-type coil;

positioning a portion of the outer surface of said workpiece to be heated in proximity to the pancake-type induction coil; and supplying said coils with a source of high frequency power to induce a current in the workpiece for a time sufficient to heat said workpiece to a desired temperature.

26. The method of claim 25, wherein said solenoid-type coil and said pancake-type coil are connected in series with the high frequency power supply.

27. The method of claim 25, wherein said high frequency power is alternating current power.

* * * * *